United States Patent [19]

Lazareth et al.

[11] Patent Number: 4,740,770

[45] Date of Patent: Apr. 26, 1988

[54] OPERATING MECHANISM FOR A LOW VOLTAGE ELECTRICAL CIRCUIT BREAKER

[75] Inventors: Michel Lazareth; William Bartolo, both of Eybens; Patrick Rousset, Grenoble; Gérard Hervouet, Jarrie, all of France

[73] Assignee: Merlin Gerin, Grenoble Cedex, France

[21] Appl. No.: 919,637

[22] Filed: Oct. 16, 1986

[30] Foreign Application Priority Data

Oct. 31, 1985 [FR] France ..... 85 16344

[51] Int. Cl.[4] ..... H01H 9/20

[52] U.S. Cl. ..... 335/171; 335/15; 335/123

[58] Field of Search ..... 335/169, 167, 170, 171, 335/172, 173, 174, 175, 6, 35, 15, 123, 176

[56] References Cited

U.S. PATENT DOCUMENTS 3,774,129 11/1973 Sugiyama ..... 335/175
4,023,127 5/1977 Mune ..... 335/172

FOREIGN PATENT DOCUMENTS 900867 10/1984 Belgium .
0147629 11/1984 European Pat. Off. .
2350679 3/1976 France .
8401663 10/1982 PCT Int'l Appl. .

*Primary Examiner*—E. A. Goldberg
*Assistant Examiner*—Lincoln Donovan
*Attorney, Agent, or Firm*—Parkhurst & Oliff

[57] ABSTRACT

A mechanism for a circuit breaker includes a support lever insulated from a contact arm and a trip lever supported by a plate fitted with limited swivelling on a pivot. A mechanical link arranged between a toggle-joint and the contact arm includes a latching stop fixed on the plate. The stop is formed by a notch cooperating with a step of the trip lever to push the end of a toggle rod back to a retracted unlatched positon, as soon as the trip lever is actuated to the tripped position. The support lever is equipped with a locking arm having a sloping part cooperating with a pawl of the handle to form a high-speed contact closing device.

10 Claims, 9 Drawing Sheets

OPERATING MECHANISM FOR A LOW VOLTAGE ELECTRICAL CIRCUIT BREAKER

BACKGROUND OF THE INVENTION

The invention relates to an operating mechanism of an electrical circuit breaker having a pair of separable contacts, housed in a moulded insulating case, and comprising:

- a manual operating handle pivotally mounted on a spindle between an open position O and a closed position F,
- a transmission rod coupled to the handle to form a toggle-joint,
- a return spring of the handle to the open position O,
- a plate mounted with rotation on a pivot, and having a latching stop cooperating by latching with the free end of the rod, so as to form a mechanical link between the handle and the plate,
- a trip lever to cause said mechanical link to be interrupted by unlatching the rod and the stop, following a fault bringing about automatic tripping of the mechanism, independently from the handle, and
- an elastic system ensuring contact pressure in the closed position of the contacts and movement of the plate to the open position after tripping has occurred.

A mechanism of the kind mentioned authorizes manual control by pivoting the operating handle and automatic control by tripping controlled by means of a thermal and/or electromagnetic trip release causing the kinematic chain between the handle and the contact arm to be interrupted in the event of an overload occurring. The mechanical parts actuating the mechanism are mounted on joints generally formed by needles individually housed in bearings arranged either in the insulating case or in a pair of fixed support plates. Assembly of such a mechanism is complicated and requires accurate positioning of the actuating parts which makes the circuit breaker assembly time longer. The unlatching force exerted by the trip lever to break the mechanical link is relatively high and increases the tripping time.

The object of the present invention is to achieve an operating mechanism of simple and reliable construction, suited both to assembly automation and to reducing the tripping time of a miniature circuit breaker.

SUMMARY OF THE INVENTION

The operating mechanism according to the invention is characterized by the fact that the moving contact is borne by a contact arm made of conducting material, securedly attached to an insulating support lever articulated on the pivot of the plate, and that the trip lever is pivotally mounted on a spindle fixed to the plate, which comprises in addition two-directional means of driving the support lever between the open and closed positions, the assembly being arranged to ensure in the closed position a relative pivoting movement of small amplitude between the plate and the support lever, due to a first contact pressure spring belonging to said elastic system.

The articulation spindle of the trip lever and the pivot come directly from the casting with the plate, which avoids using special needles.

The mechanism is advantageously fitted with an auxiliary high-speed contact closing device, by means of a blocking arm disposed on the insulating support lever of the contact arm. The blocking arm cooperates with a pawl pivotally mounted on the spindle of the handle.

The latching stop of the plate is formed by a notch having a sloping part designed to push the end of the rod towards a retracted unlatched position, when the trip lever is in the tripped position. The elastic system comprises a spring, arranged to exert a torque on the plate bringing about the unlocking action of the sloping part on the rod to break the mechanical link. The tripping force provided by the trip release is minimal and only has to overcome the opposing force of the return spring of the trip lever.

The trip lever is advantageously equipped with a step holding the end of the rod against the latching stop when the mechanical link is established.

The presence of the plate constitutes both a kinematic transmission part of the rod coupled to the handle, and a combined support part of the contact arm and of the trip lever.

The support lever and the trip lever extend parallel to one another with a transverse offset in relation to the vertical plane passing through the plate. The first arm of the trip lever protrudes out from the insulating support lever in the direction of the electromagnetic trip release, when the circuit breaker is in the closed position, the assembly being arranged so that the electromagnetic trip release striker successively drives the trip lever to the tripped position, and the support lever to the contact separation position, when the pole current exceeds the tripping threshold of said electromagnetic trip release.

The longitudinal separation of the pivot of the plate and the pivoting spindle of the trip lever, combined with the transverse offset between the support lever and the trip lever, authorize a tripping order of the nearby pole, as soon as the striker begins its tripping travel. A fault on a phase thereby brings about simultaneous tripping of the juxtaposed poles of a multipole circuit breaker.

The operating mechanism may include a mechanical contact position indicator. Said indicator comprises positioning marks on the upper edge of the plate, moving facing the inside wall of the front panel of the case, which comprises an indicator mark observation window.

BRIEF DESCRIPTION OF THE DRAWINGS

Other advantages and characteristics will become more clearly apparent from the following descripition of a several embodiments of the invention, given as examples only, and represented in the accompanying drawings, in which.

DESCRIPTION OF THE PREFERRED EMBODIMENT

Figure 1:
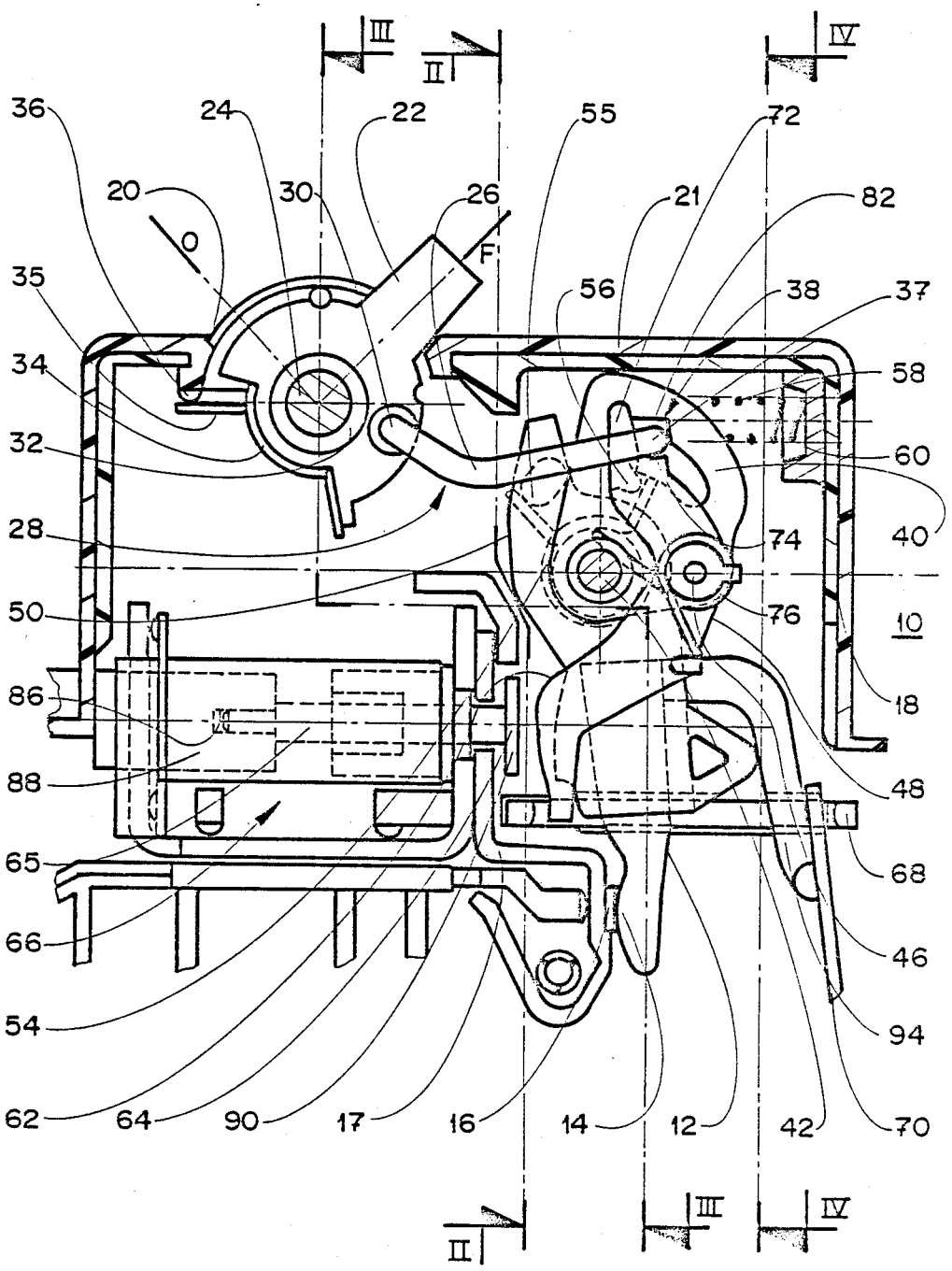
FIG. 1 is an elevational view of the operating mechanism according to the invention, the circuit breaker being shown in the closed position.
Figure 2:
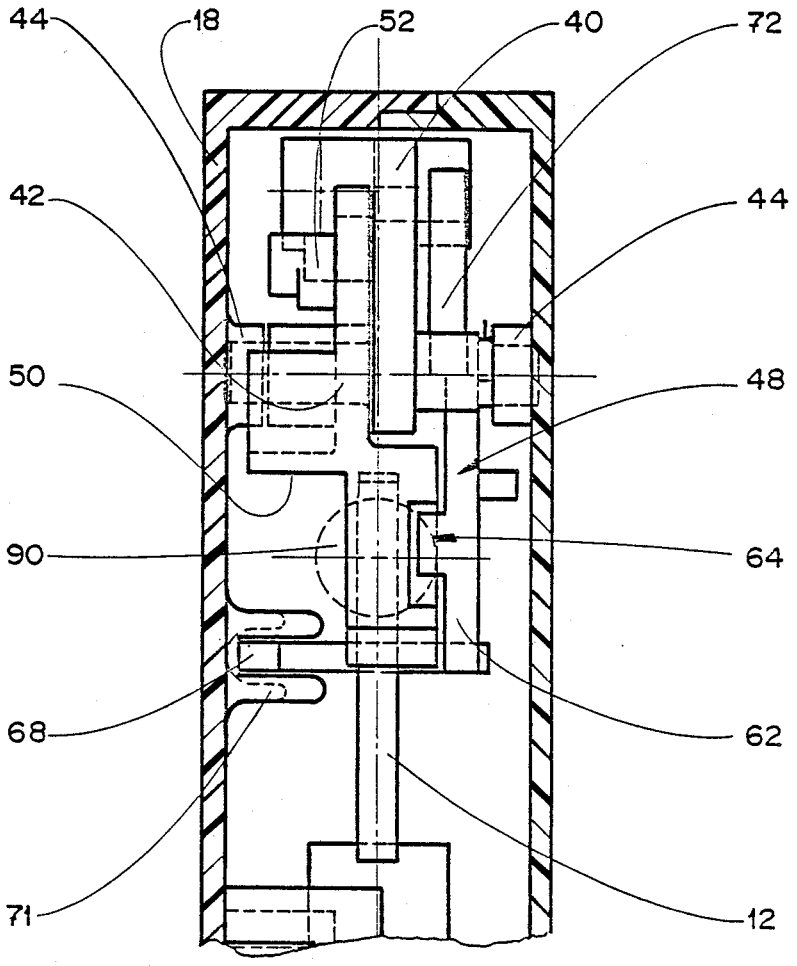
FIGS. 2 to 4 show profile and cross-sectional views along the lines II—II, III—III, IV—IV of FIG. 1.
Figure 3:
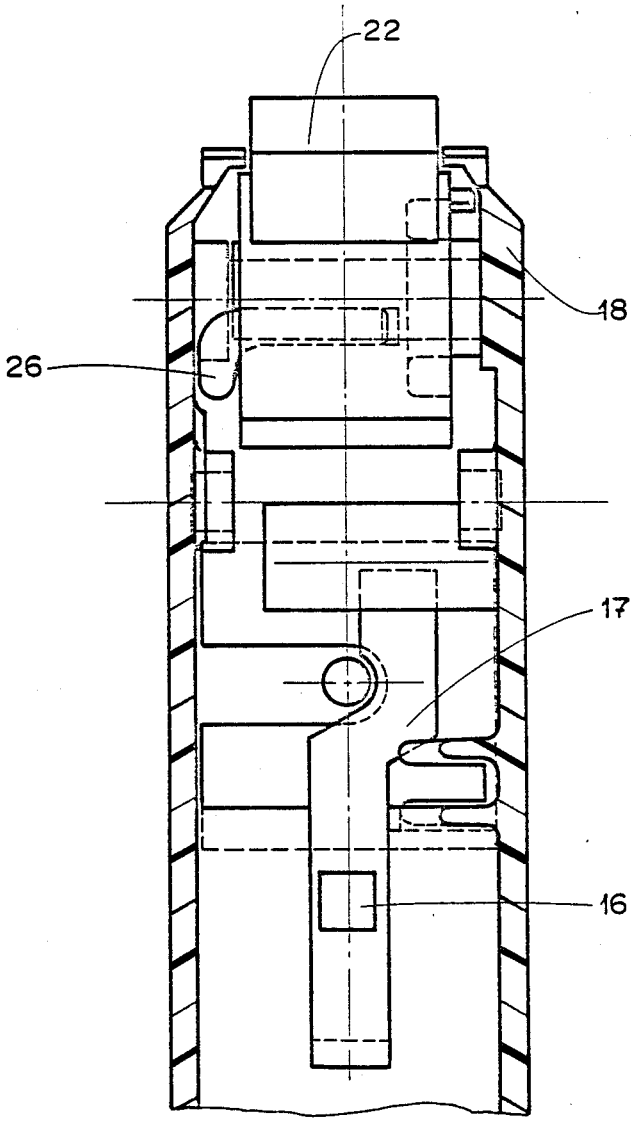
Figure 4:
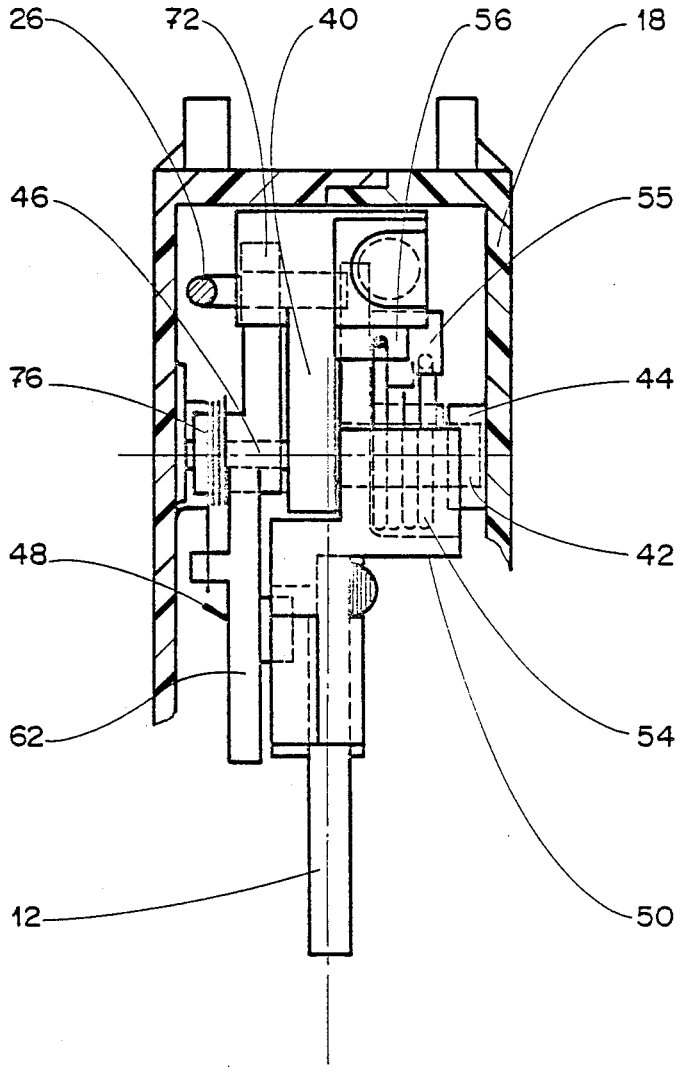

Referring now to FIGS. 1 to 6, the operating mechanism 10 of a miniature circuit breaker actuates a moving contact arm 120 ne end of which bears a contact part 14 cooperating with a stationary contact 16. The mechanism 10 is housed inside an insulated case 18, above the arc chute (not shown). An opening 20 is arranged in the front panel 21 of the case 18 to allow a pivoting manual operating handle 22 to pass through, said handle being mounted with limited pivoting on a fixed spindle 24 between a closed position (FIG. 1) in which the contacts 14, 16 are closed, and an open position (FIG. 6) corresponding to separation of the contacts 14, 16. The handle 22 has an internal extension, coupled to a transmission rod 26 to constitute a toggle-joint device 28 whose joint 30 is excentrically located in relation to the fixed spindle 24 of the handle 22. The portion of the extension situated between the spindle 24 and the joint 30 forms the other rod 32 of the toggle-joint 28. The transmission rod 26 comprises a U-shaped bracket, notably made of steel wire. The handle 22 is biased towards the open position by a return spring 34, notably of the spiral type fitted on the spindle 24 and one end 35 of which bears on a boss 36 of the case 18.

The stationary contact 16 is borne by a conductor 17 fixed to the body of the electromagnetic trip release 66.

Opposite the joint 30, the free end 37 of the transmission rod 26 cooperates by latching with a latching stop 38 arranged on a plate 40. The latter is pivotally mounted on a cylindrical pivot 42, transversely positioned in aligned bearings 44, fitted in the opposite faces of the case 18. The plate 40 comprises a spindle 46 excentric in relation to the pivot 42, and the trip lever 48 is mounted with limited pivoting on the spindle 46 between a charged position and a tripped position.

The moving contact arm 12 of conducting material, notably copper, is secured to a support lever 50 of insulating material, articulated on the pivot 42 of the plate 40 opposite the trip lever 48. The plate 40 is equipped with a lug 52 driving the support lever 50 between the open and closed positions of the contact arm 12. The contact arm 12 can be secured to the insulating support lever 50 by ultrasonic welding.

A contact pressure spring 54, of the torsion type, coaxially surrounds the pivot 42 bearing on a boss 55 of the support lever 50, and a pin 56 of the plate 40. A stored energy spring 58, of the compression type, is fitted between a fixed stop 60 of the case 18 and the pivoting plate 40, and biases the latter towards the open position, when tripping of the mechanism 10 occurs. The presence of the spring 54 allows a relative movement of small amplitude between the plate 40 and the support lever 50.

The trip lever 48 pivoting on the spindle 46 comprises a lower lever arm 62 able to be actuated either by the striker 64 of an electromagnetic trip release 66, or by an unlocking rack 68 cooperating with the bimetallic strip 70 of the thermal trip release. The rack 68 is guided in translation by means of a guiding passage 71 forming a part of the case 18. The upper lever arm 72 of the trip lever 48 is equipped with a step 74 cooperating with the free end 37 of the transmission rod 26. A return spring 76 of the spiral type is fitted around the spindle 46 and biases the trip lever 48 towards the charged position.

In this charged position (FIG. 1), the end 37 of the rod 26 rests on the bearing face of the step 74 and is held by the upper lever arm 72 against the latching stop 38, in such a way as to form a mechanical link between the handle 22 and the plate 40. This link can be interrupted in the course of tripping by the transmission rod 26 unlatching from the latching stop 38 which takes place when the trip lever 48 pivots counterclockwise (see FIG. 5).

The latching stop 38 of the plate 40 is formed by a notch 82 presenting a slope releasing the end 37 of the rod 26 to an unlocked position when the trip lever 48 pivots to the tripped position. The force of the mechanism opening spring 58 is greater than that of the return spring 34 of the handle 22.

The striker 64 of the electromagnetic trip release 66 comprises an unlocking push-rod 65 of an insulating material, having one end forcibly fitted into a central bore 86 of the plunger 88, and an opposite end, fitted with a cylindrical cap 90 extending in the middle area of the case 18. The cap 90 is located facing the trip lever 48 and the support lever 50, the latter being staggered transversely, in such a way as to be driven successively by the cap 90, when magnetic attraction of the plunger 88 of the electromagnetic trip release 66 occurs. In the charged position (FIG. 1), it can be noted that the lower lever arm 62 protrudes out from the support lever 50 in the direction of the trip release 66. When tripping occurs following a short-circuit, the propulsion of the cap 90 of the striker 64 causes in the first phase counterclockwise pivoting of the trip lever 48 to the tripped position, followed in a second phase by driving the support lever 50 of the contact arm 12 to the open position of the contacts 16, 14.

The position of the latching stop 38 on the plate 40 is situated opposite the zone where the trip release strikes the lever arm 62 in relation to a transverse plane passing through the pivot 42 and the spindle 46. The active part of the lower lever arm 62, disposed facing the cap 90 is slightly convex so that the tripping force exerted by the striker 64 remains appreciably constant when the trip lever 48 pivots around the spindle 46.

Operation of the circuit breaker operating mechanism 10 is as follows:

MANUAL CONTROL

In the course of a manual operation of the circuit breaker mechanism 10, the kinematic chain connecting the handle 22 to the contact arm 12 is never broken due to the rod 26 catching continuously in the latching stop 38 of the plate 40. The movement of the handle 22 is transmitted to the contact arm 12 via the rod 26, the plate 40 and the insulating support lever 50. Manual closing is controlled by pivoting of the handle 22 clockwise to the position F represented in FIG. 1. The position F of the handle 22 is stable as the dead-point of the toggle-joint 28 has been overshot, the return force of the spring 34 exerting itself on the handle 22 being insufficient to overcome the locking force of the toggle-joint 28. Manual opening of the circuit breaker results from a movement of the handle 22 in the reverse direction to the position O (FIG. 6) causing the toggle-joint 28 to be broken, and the plate 40 and the support lever 50 to pivot counterclockwise around the pivot 42.

AUTOMATIC TRIPPING

Figure 5:
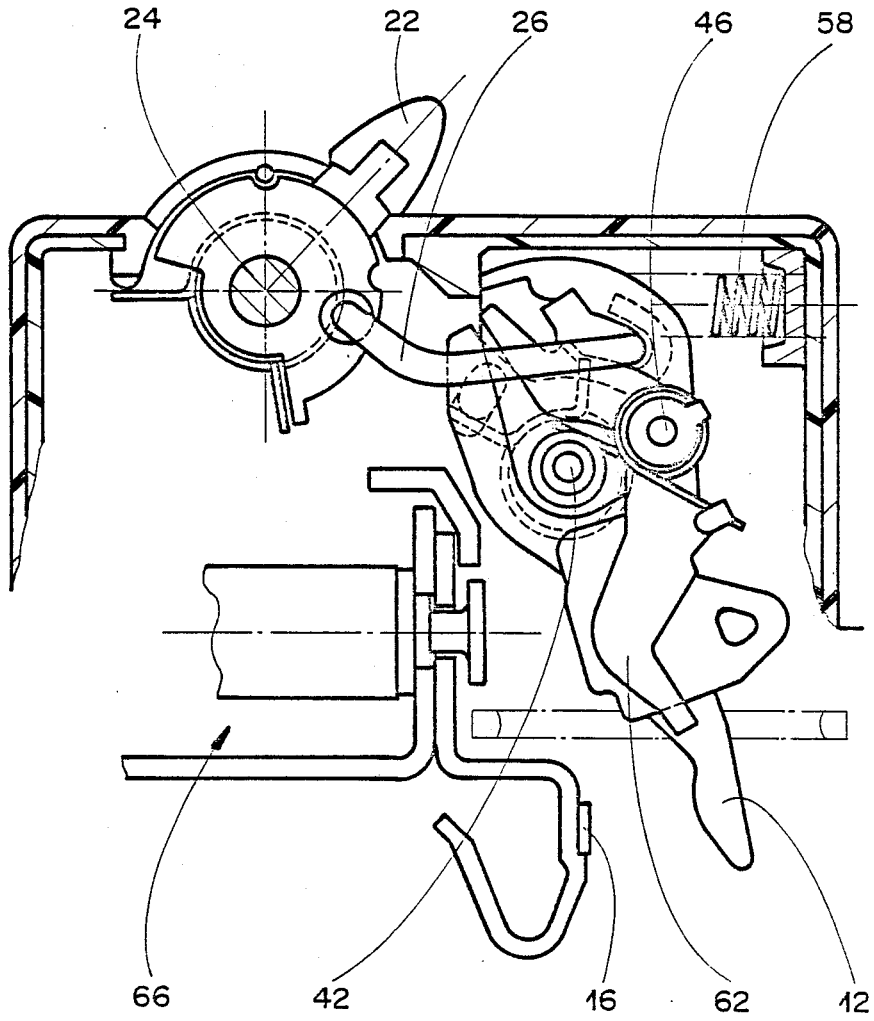
FIG. 5 is an identical view to FIG. 1, in the course of tripping of the mechanism, the handle being kept in the closed position F.
Figure 6:
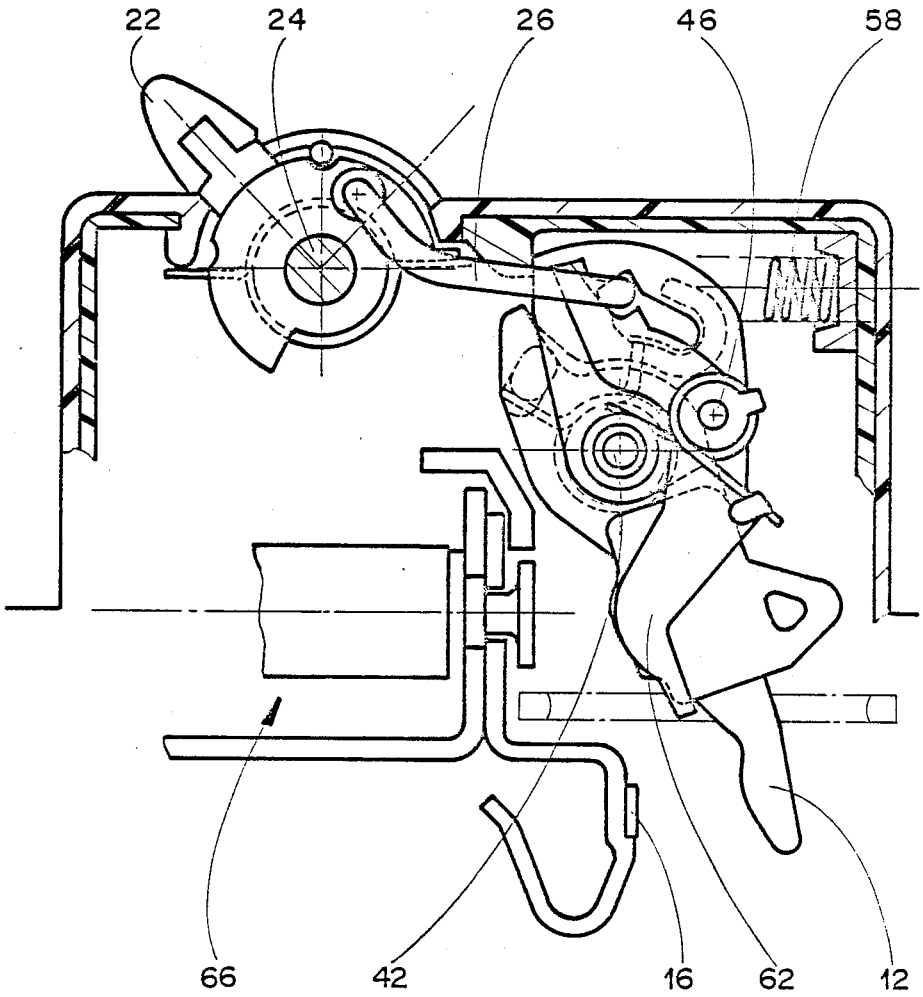
FIG. 6 is an identical view to FIG. 1, in the open position of the circuit breaker.

Following an overload or short-circuit current, tripping of the circuit breaker is brought about by the bimetallic strip 70 of the thermal trip release or by the striker 64 of the electromagnetic trip release 66 making the trip lever 48 pivot counterclockwise from the charged position (FIG. 1) to the unlocked position (FIG. 5). The upper lever arm 72 moves away from the end 37 of the rod 26 and causes the locking force to disappear. The torque exerted by the spring 58 in the opening direction urges a slight counterclockwise pivoting of the plate 40, in such a way as to push the end 37 of the rod 26 downwards, after the step 74 has been released from the trip lever 48. In the course of this first ripping phase, the rod 26 is unlatched from the latching stop 38 of the plate 40, and the mechanical link between the handle 22 and the contact arm 12 is interrupted. Release of the stored energy spring 58 then causes the contact arm 12 and the plate 40 to pivot freely to the open position represented in FIG. 6. In the course of this second tripping phase, the action of the return spring 34 of the handle 22 breaks the toggle-joint 28 moving the handle 22 to the open position O. Automatic resetting of the mechanism 10 is performed in this position by the end 37 of the rod 26 latching with the latching stop 38 of the plate 40. The step 74 of the lever arm 72 locks the rod 26 so as to re-establish the mechanical link between the handle 22 and the support lever 50 of the contact arm 12. The mechanism 10 is then ready for a fresh closing operation by manually moving the handle 22 from the position 0 (FIG. 6) to the position F (FIG. 1).

The upper edge of the plate 40 can be equipped with marks indicating the open and closed positions of the contact arm 12. The mark are visible from the outside through a window (not shown) in the front panel 21, and constitute a mechanical indicator providing an indirect display of the separation of the contacts 14, 16, by means of the pivoting plate 40. This display is reliable given that the contact arm 12 is securedly attached to the support lever 50 moved by the plate 40.

It should be noted that the plate 40 acts both as transmission device for the rod 26 and as support for the contact arm 12 and the trip lever 48. The pivot 42 and spindle 46 come directly from moulding with the plate 40, which avoids the use of special metal needles. The plate 40 is produced by moulding from a metal or plastic material. A system of fixed stops limits the opening travel of the mechanism 10.

The pivot 42 constitutes a common pivoting axis of the plate 40 and of the support lever 50, so as to achieve reduced overall dimensions of the mechanism 10. The longitudinal separation of the pivot 42 of the plate 40 and the pivoting spindle 46 of the trip lever 48, combined with the transverse offset between the support lever 50 and the lower lever arm 62, authorize a tripping order of the nearby pole as soon as the lever 48 begins its tripping travel. Transmission of the multipole tripping order is performed by means of a drive pin (not shown), securedly attached to the trip lever 48 at the level of the spindle 46. A fault on a phase brings about simultaneous tripping of the juxtaposed poles of a multipole circuit breaker. The mechanism 10 is in fact made up of two distinct sub-assemblies which can be pre-assembled outside the case 18 and fitted automatically when the circuit breaker is assembled.

The first sub-assembly comprises the plate 40 on which are mounted the insulating support lever 50 fitted on the pivot 42, and the trip lever 48 articulated on the spindle 46. The contact arm 12 is linked to the bimetallic strip 70 by a conducting braid 94. The first contact pressure spring 54 surrounding the pivot 42 takes its bearing on the boss 55 of the support lever 50 and the pin 56 of the plate 40. The second return spring 76 of the trip lever 48 is then fitted around the spindle 46. Installation of the first sub-assembly is performed by simply positioning the pivot 42 in a bearing 44 of the case 18, and then inserting the compression spring 58.

The second sub-assembly comprises the handle 22, its return spring 34 and the transmission rod 26. The torsion spring 34 is fitted in the handle 22, and the strand 35 is taken up by the boss 36 of the case 18 when the second sub-assembly is fitted. The free end 37 of the rod 26 is then positioned in the notch 82 of the latching stop 38 to provide a mechanical link between the handle 22 and the contact arm 12.

Figure 7:
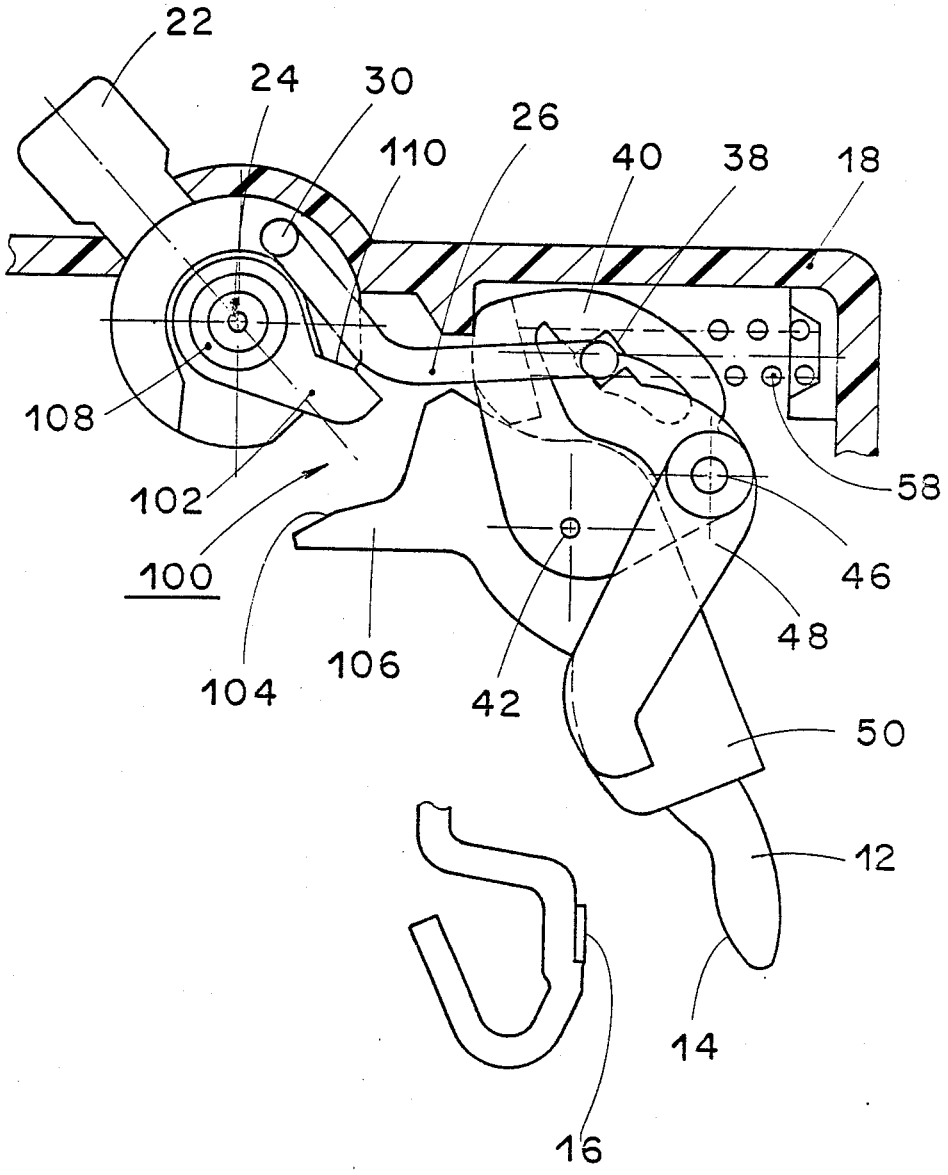
FIGS. 7 to 9 represent an alternative embodiment of the mechanism according to FIG. 1 with high-speed contact closing, the mechanism being represented respectively in the open position, in the course of closing and in the fully closed position.
Figure 8:
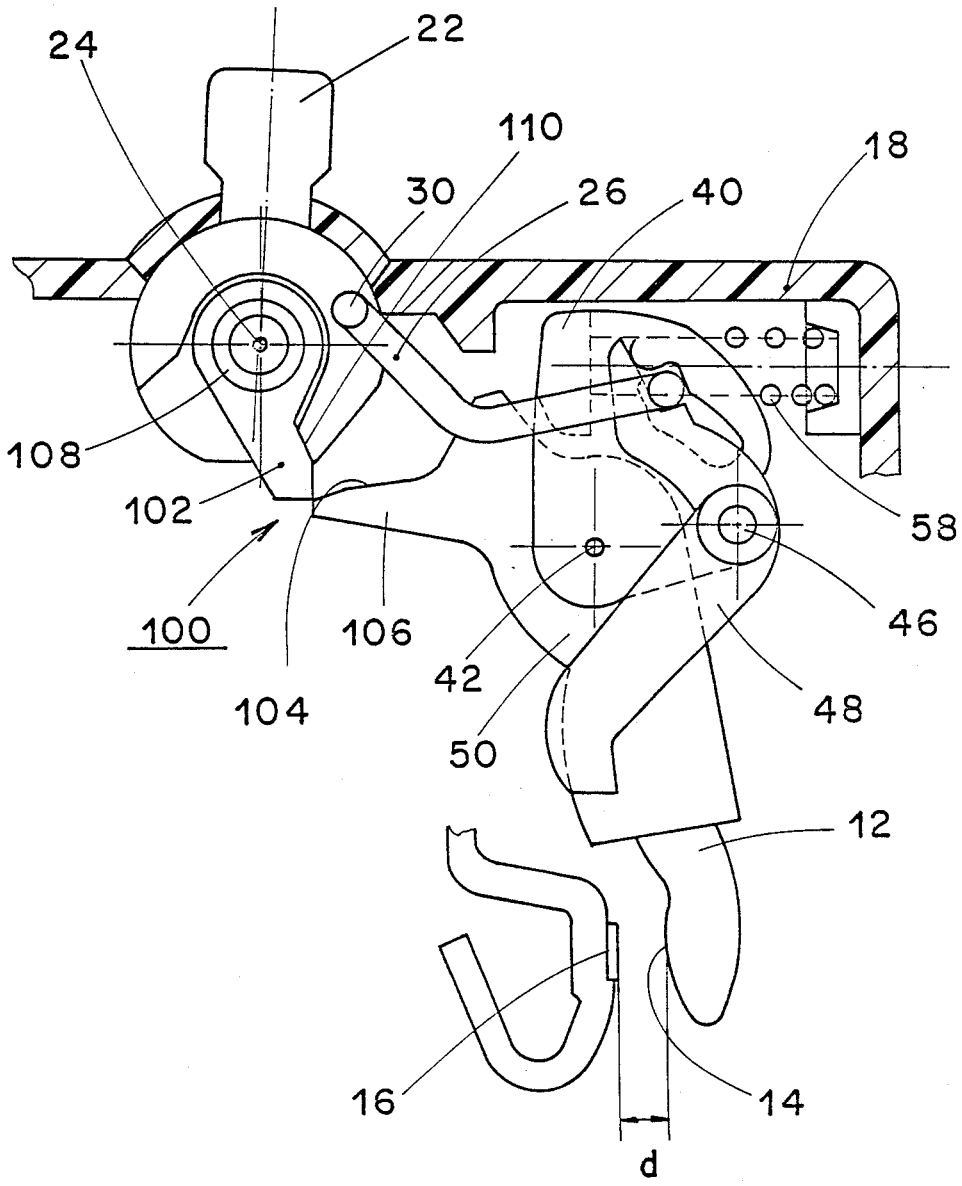
Figure 9:
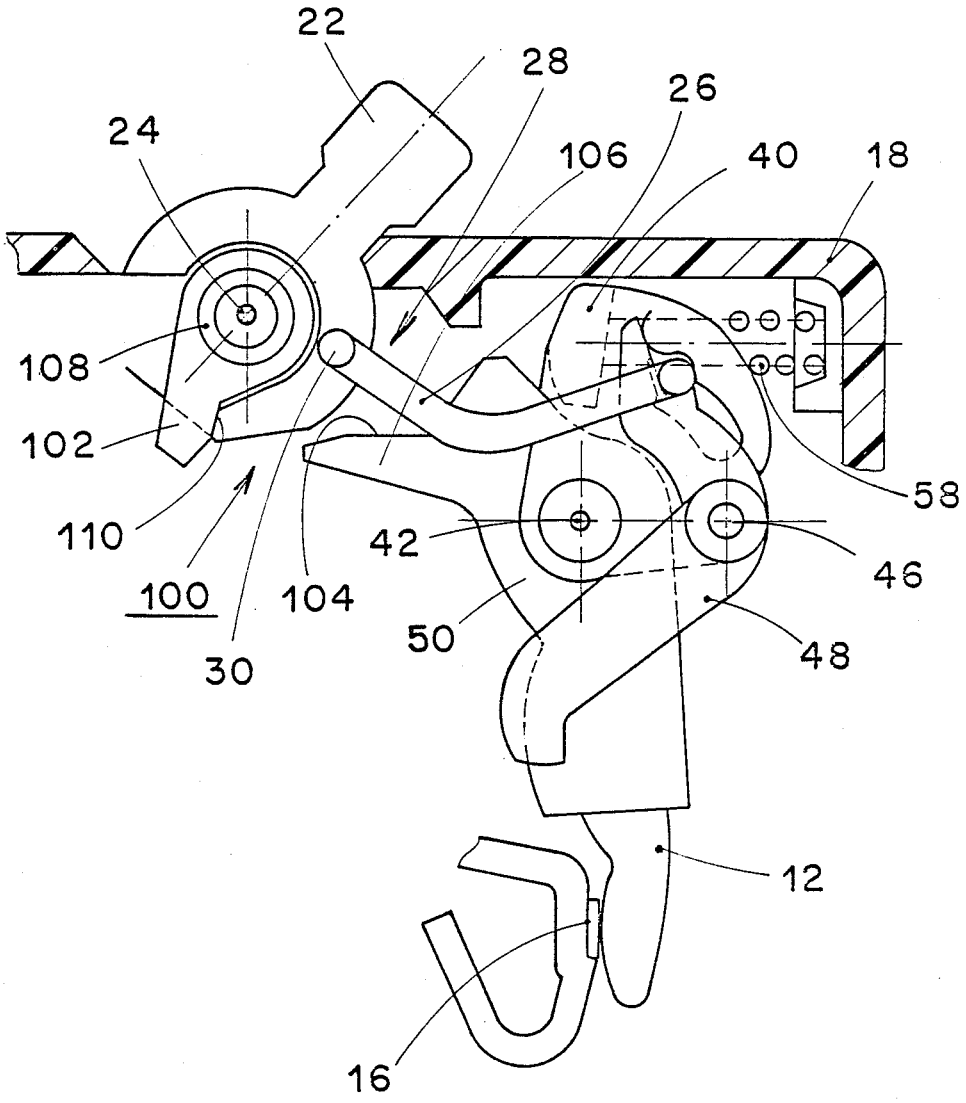

In the alternative embodiment represented in FIGS. 7 to 9, the same reference numbers will be used to designate identical parts to those of the circuit breaker according to FIGS. 1 to 6. The circuit breaker operating mechanism 10 is equipped with an auxiliary high-speed closing device, designated by the general reference 100, and comprising a retaining pawl 102 cooperating with a sloping part 104 extending along a temporary blocking arm 106 of the insulating support lever 50. The pawl 102 pivotally mounted on the spindle 24 of the handle 22, is associated with a return spring 108 which biases the pawl 102 counterclockwise against a stop 110 of the handle 22. The blocking arm 106 is disposed between the transmission rod 26 and the electromagnetic trip release 66. Operation of the auxiliary high-speed closing device 100 is as follows:

closing of the circuit breaker is performed by a movement of the handle 22 from the left (FIG. 7) to the right (FIG. 9). At the begining of the closing travel, the kinematic chain connecting the handle 22 to the plate 40 drives the contact arm 12 towards the stationary contact 16. The pawl 102 turns clockwise with the handle 22, and moves towards the blocking arm 106 of the support lever 50, which turns in the opposite direction. The pawl 102 engaging with the sloping part 104 of the blocking arm 106 stops the rotation of the support lever 50, and holds the contact part 14 of the contact arm 12 at a preset distance d from the stationary contact 16 (FIG. 8). The plate 40 then remains immobile, but the end of the pawl 102 can nevertheless slide along the sloping part 104, allowing the closing movement of the handle 22 to be pursued. This results in an accumulation of energy in the return spring 34 of the handle 22 up to the end of the sliding movement of the pawl 102 on the sloping part 104 (FIG. 8). The final movement of the handle 22 to the position in FIG. 9 causes the plate 40 to be unlocked after the arm 106 has been released by the pawl 102, followed by high-speed closing of the contact arm 12 due to the action of the kinematic chain. The spring 34 being released accelerates overshooting of the dead-point of the toggle-joint 28. The closing speed of the moving contact 14 is thus independent from the actuating force of the handle 22.

Manual opening of the circuit breaker is performed by a reverse switching movement of the handle 22 (going from the position in FIG. 9 to that of FIG. 7). Due to the action of its return spring 108, the pawl 102 retracts and remains in the inactive position, in such a way as not to hinder free pivoting of the plate 40 and the support lever 50 counterclockwise to the open position (FIG. 7).

What we claim is:

1. An operating mechanism of an electrical circuit breaker, having a trip release and a pair of separable stationary and moving contacts having open and closed positions, said operating mechanism being housed in a moulded insulating case, and comprising:

a manual operating handle pivotally mounted on a first spindle between a first open position and a second closed position corresponding respectively to the open and closed positions of the contacts;

a transmission rod having one end coupled to the handle to form a toggle-joint and an opposite free end;

a return spring for urging the handle toward the first open position;

a plate rotatably mounted on a pivot, and having a latching stop cooperating by latching with the free end of the transmission rod, so as to form a mechanical link between the handle and the plate, the plate having an open position corresponding to the open position of the contacts;

a trip lever for causing said mechanical link to be interrupted by unlatching the transmission rod and the latching stop, following a fault bringing about automatic tripping of the mechanism, independently from the handle, said trip unit being pivotably mounted on a second spindle fixed to the plate;

an elastic system having a first spring for ensuring contact pressure in the closed position of the contacts, and a second spring causing movement of the plate to the open position after tripping has occurred;

a contact arm made of conducting material and carrying said moving contact;

an insulating support lever articulated on the pivot of the plate and attached to the contact arm; and bidirectional driving means arranged upon said plate for actuating the support lever between the open and closed positions of the contacts, to ensure in the closed position of the contacts a relative pivoting movement of small amplitude between the plate and the support lever due to the first spring.

2. An operating mechanism according to claim 1, wherein the insulating support lever is fitted with a blocking arm, cooperating with a pawl pivotally mounted upon the first spindle of the handle, so as to form a high-speed contact closing device.

3. An operating mechanism according to claim 2, wherein the pawl is associated with a return spring allowing the pawl to retract to an inactive position due to the action of the blocking arm, so as not to hinder the rotating movement of the plate in the circuit breaker opening direction.

4. An operating mechanism according to claim 3, wherein the blocking arm comprises a sloping part cooperating slidingly with the pawl in the closing direction, said sloping part being arranged to temporarily stop the rotating movement of the support lever and of the plate by maintaining the contact arm at a preset distance from the stationary contact, and at the same time to allow movement of the handle to continue to the closed position, retraction of the pawl taking place at the end of closing travel of the handle bringing about unlocking of the plate and high-speed closing of the contacts.

5. An operating mechanism according to claim 1, wherein the trip lever comprises a first lever arm able to be actuated by the trip release to a tripped position, and a second lever arm able respectively to lock in a charged position the free end of the transmission rod against the latching stop and to unlock said free end in the tripped position to break the mechanical link between the toggle-joint and the contact arm, the latching stop including a notch arranged in the plate and presenting a sloping part designed to push the free end of the transmission rod to a retracted unlatching position, when the trip lever is in the tripped position.

6. An operating mechanism according to claim 5, comprising a magnetothermal trip release formed by a thermal trip release with a bimetallic strip and an electromagnetic trip release with a striker, wherein the support lever and the trip lever extend parallel to one another with a transverse offset in relation to the vertical plane passing through the plate, and wherein first lever arm of the trip lever protrudes out from the insulating support lever in the direction of the electromagnetic trip release, when the circuit breaker is in the closed position, the striker of the electromagnetic trip release successively driving the trip lever to the tripped position, and the support lever to the contact separation position, when the pole current exceeds the tripping threshold of said electromagnetic trip release.

7. An operating mechanism according to claim 5, wherein the first trip lever arm includes an active part disposed facing the striker, the active part being slightly convex so that the tripping force exerted by the electromagnetic trip release remains appreciably constant when the trip lever pivots to the tripped position.

8. An operating mechanism according to claim 5, wherein the second energy storage spring of the elastic system is designed to exert on the plate a torque tending to break said mechanical link in the tripped position of the trip lever, and to cause the plate to pivot to the open position of the circuit breaker, and wherein the second trip lever arm is equipped with a step holding the free end of the transmission rod against the latching stop when said mechanical link is established, a return spring biasing the trip lever to the charged position.

9. An operating mechanism according to claim 1, wherein the mechanism is made up of two sub-assemblies which can be pre-assembled outside the case, the first sub-assembly comprising the plate on which are mounted the support lever of the contact arm and the trip lever, the second sub-assembly comprising the handle associated with the transmission rod.

10. An operating mechanism according to claim 1, wherein a mechanical contact position indicator comprises positioning marks on the upper edge of the plate, movably facing an inside wall of the front panel of the case, a portion of the inside wall of the front panel opposite the positioning marks comprising an indicator mark observation window.

* * * * *